US005398703A

United States Patent [19]

Belvederi et al.

[11] Patent Number: 5,398,703

[45] Date of Patent: Mar. 21, 1995

[54] METHOD OF SIMULTANEOUSLY PRODUCING TWO CONTINUOUS CIGARETTE RODS

[75] Inventors: Bruno Belvederi, S. Martino Di Monte S. Pietro; Fiorenzo Draghetti, Medicina, both of Italy

[73] Assignee: G.D Societa' Per Azioni, Bologna, Italy

[21] Appl. No.: 144,813

[22] Filed: Oct. 28, 1993

[30] Foreign Application Priority Data

Oct. 28, 1992 [IT] Italy ..... BO92A0378

[51] Int. Cl.[6] ..... A24C 5/18

[52] U.S. Cl. ..... 131/84.1; 131/110

[58] Field of Search ..... 131/84.1, 84.3, 108, 131/109.2, 110

[56] References Cited

U.S. PATENT DOCUMENTS

| | | | |
|---|---|---|---|
| 4,372,326 | 2/1983 | Seragnoli | 131/84.1 X |
| 4,889,138 | 12/1989 | Heitmann et al. | 131/84.1 |
| 5,009,238 | 4/1991 | Heitmann | 131/110 X |
| 5,022,415 | 6/1991 | Belyederi et al. | 131/84.1 |
| 5,154,190 | 10/1992 | Heitmann | 131/84.1 |
| 5,230,353 | 7/1993 | Heitmann | 131/84.1 |

FOREIGN PATENT DOCUMENTS

| | | |
|---|---|---|
| 2191381 | 12/1987 | United Kingdom . |
| 2254995 | 10/1992 | United Kingdom . |

*Primary Examiner*—Jennifer Bahr

*Attorney, Agent, or Firm*—Marshall, O'Toole, Gerstein, Murray & Borun

[57] ABSTRACT

In a machine for simultaneously producing two continuous cigarette rods from respective layers of tobacco, shredded tobacco is fed by an air current along an upfeed duct, closed off at the top by a first and a second suction conveyor, in such a manner as to form two substreams mainly consisting respectively of light and heavy tobacco particles and directed respectively towards the first and second conveyor. Each of the two substreams impinges, along the upfeed duct, on respective deflecting and mixing elements, which deflect part of each substream towards the other substream so as to feed two substantially identical final secondary streams onto the suction conveyors.

13 Claims, 1 Drawing Sheet

METHOD OF SIMULTANEOUSLY PRODUCING TWO CONTINUOUS CIGARETTE RODS

BACKGROUND OF THE INVENTION

The present invention relates to a method of simultaneously producing two continuous cigarette rods.

Cigarette manufacturing machines for simultaneously producing two continuous cigarette rods are already known, and whereby the continuous rods are fed past a cutting head for simultaneously producing two streams of either plain cigarettes, or cigarette portions from which to form filter-tipped cigarettes.

In addition to the problem, commonly encountered on any type of machine, of producing continuous rods that are homogeneous and of a constant given weight per unit length, a major problem of dual-rod machines of the aforementioned type is that of producing two substantially identical continuous rods, which, when cut, provide for forming substantially identical streams of plain cigarettes or cigarette portions in conformance with strict manufacturing tolerances.

In the past, substantially two methods have been adopted by dual-rod machine manufacturers for overcoming the above problem.

According to one known method, described for example in U.S. Pat. No. 4,372,326, a single stream of shredded tobacco is divided by a movable wall into two secondary streams, each of which is fed in the form of a continuous layer of tobacco on to a respective conveyor. The position of the movable wall is adjusted for regulating the flow rate of the two secondary streams as a function of signals emitted by members for controlling the weight per unit length of the tobacco layers.

Though successfully providing for two tobacco layers of substantially the same weight, the above method fails to provide for simply and rapidly controlling distribution, within the two secondary streams, of the light and heavy tobacco particles, i.e. the volume of the tobacco layers as they are formed on the two conveyors.

The second known method, described for example in Italian Patent Application n. 3662A/88 or British Patent n. 2,240,026, is based on the assumption that, in a stream of shredded tobacco, the characteristics of a portion of relatively limited area cannot possibly differ noticeably from those of a similar adjacent portion of the tobacco stream.

On the basis of this assumption, for producing two substantially uniform, identical tobacco layers, the above method provides for dividing a main stream of shredded tobacco into a number of relatively small secondary streams, and for feeding each secondary stream in each pair of adjacent secondary streams on to a respective tobacco layer conveyor.

This second method also provides for no more than statistical, as opposed to direct, control of the weight and volume of the two tobacco layers.

SUMMARY OF THE INVENTION

It is an object of the present invention to provide a straightforward, precise, direct method of feeding two streams of shredded tobacco of substantially the same weight and volume on to both conveyors.

According to the present invention, there is provided a method of simultaneously producing two continuous cigarette rods from respective tobacco layers supplied by respective conveyors; characterized by the fact that it comprises stages consisting in forming, from a main stream of shredded tobacco, two substreams of shredded tobacco, one consisting predominantly of relatively heavy tobacco particles, and the other predominantly of relatively light tobacco particles; directing the two substreams respectively towards a first and second of said conveyors; and mixing part of each substream with the other substream, so as to feed on to the two conveyors two final secondary streams containing substantially the same concentration of light and heavy tobacco particles.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
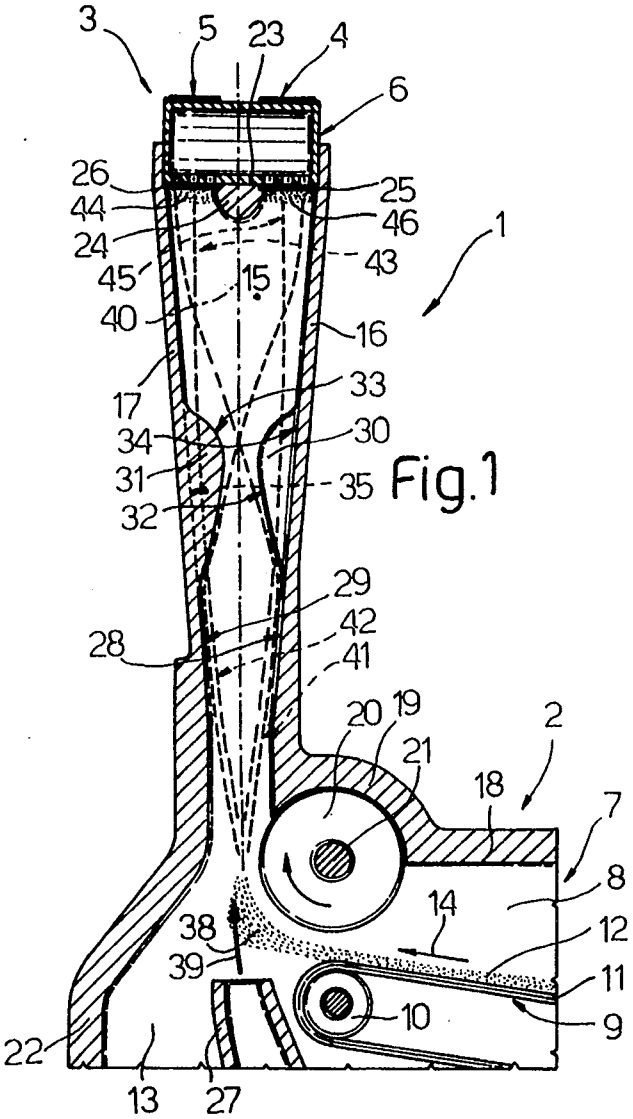
FIG. 1 shows a schematic section, with parts removed for clarity, of a portion of a cigarette manufacturing machine implementing the method according to the present invention.

Number 1 in FIG. 1 indicates a dual-rod cigarette manufacturing machine of the type described, for example, in U.S. Pat. No. 4,372,326 to which full reference is made herein in the interest of full disclosure.

Machine 1 comprises, in known manner, a first portion 2 for supplying a continuous stream of shredded tobacco to a second portion 3, the input of which is defined, in known manner, by two side by side, substantially parallel suction conveyors 4 and 5 looped about a suction box 6 and extending substantially perpendicular to the FIG. 1 plane.

As shown in FIG. 1, portion 2 comprises an output portion 7 defined by a substantially horizontal duct 8 housing, in known manner, a powered conveyor belt 9 looped about two pulleys 10 (only one shown) and having a substantially horizontal top branch 11 for feeding a layer 12 of shredded tobacco to a chamber 13 in a direction 14 parallel to the FIG. 1 plane and substantially perpendicular to the traveling directions of conveyors 4 and 5.

From chamber 13 there extends upwards an upfeed duct 15 defined laterally by two walls 16 and 17 perpendicular to direction 14 and the FIG. 1 plane. Wall 16 is connected to top wall 18 of duct 8 by a curved wall portion 19 tangent to the outer periphery of a known hurling roller 20 housed inside chamber 13 between the output of duct 8 and the input of duct 15. Together with wall 17, roller 20 defines an input portion of duct 15, and is fitted on to a powered shaft 21 perpendicular to direction 14 and the FIG. 1 plane, and with which it rotates clockwise in FIG. 1. Wall 17 is connected to the top end of wall 22 of chamber 13 opposite the output end of branch 11 of conveyor 9.

Walls 16 and 17 diverge so that duct 15 flares upwards, and present a width, measured perpendicular to the FIG. 1 plane, substantially equal to the width of conveyor 9. At the top ends, walls 16 and 17 enclose box 6, the pierced bottom wall 23 of which closes off the top of duct 15, and presents an intermediate longitudinal rib 24 extending perpendicular to the FIG. 1 plane and parallel to conveyors 4 and 5, and which separates bottom branches 25 and 26 of conveyors 4 and 5 respectively.

A compressed air supply duct 27 terminates inside chamber 13, with its output end aligned with the input end of duct 15 and slightly beneath the output end of branch 11 of conveyor 9.

Figure 2:
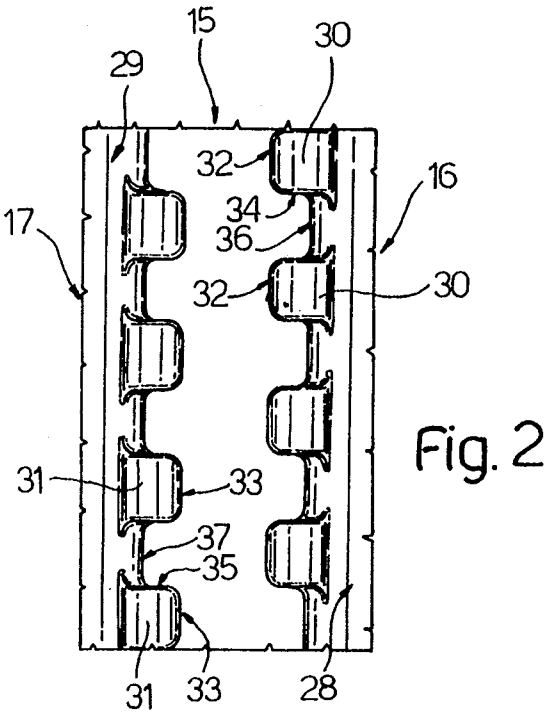
FIG. 2 shows a larger-scale plan view of a detail in FIG. 1.

Walls 16 and 17 present respective inner surfaces 28 and 29 facing each other and having respective rows of deflecting projections 30 and 31 defined externally by respective identical curved surfaces 32 and 33. Projections 30 and 31 are arranged in respective rows facing each other at respective intermediate portions of surfaces 28 and 29 and substantially perpendicular to the FIG. 1 plane. More specifically (FIG. 2), each pair of projections 30 and each pair of projections 31 define respective channels 34 and 35, the end surfaces of which are defined by respective strips 36 and 37 of surfaces 28 and 29 directed parallel to the FIG. 1 plane and substantially the same width as surfaces 32 and 33. In other words, at rows of projections 30 and 31, each lateral surface of duct 15 presents a first half defined by respective strips 36, 37, and a second half defined by respective curved surfaces 32, 33. Finally (FIG. 2), projections 30 are equal in number to projections 31, and are offset in relation to projections 31 so that each surface 32 faces a respective strip 37, and each surface 33 faces a respective strip 36.

In actual use, the layer 12 of shredded tobacco supplied by branch 11 of conveyor 9 proceeds, by virtue of both inertia and the thrust imparted by roller 20, beyond the output end of branch 11, to produce a stream 38 of tobacco, which, traveling in direction 14, flows into chamber 13 through the passage defined between roller 20 and the output end of duct 27, and, on encountering the compressed air from duct 27, is substantially deflected in direction 39, parallel to the axis 40 of duct 15 and substantially perpendicular to direction 14 and the rows of projections 30 and 31, into duct 15.

In connection with the above, it should be pointed out that, despite substantially all the particles in stream 38 engaging duct 15 (with the exception of very heavy waste particles, which drop down into the bottom of chamber 13), not all the particles are deflected the same way by the compressed air from duct 27. In particular, by virtue of the combined effect of the thrust imparted by the compressed air and roller 20, of the so-called "wall effect", and, partly, of the upward-flaring design of duct 15, which results in expansion of the air stream from duct 27 and the formation of vortices by which the tobacco particles are drawn away from axis 40, the lighter particles are deflected more sharply and tend to adhere to wall 16, while the heavier particles, by force of inertia, tend to continue moving parallel to direction 14, and to adhere to wall 17. In other words, by virtue, more or less, of at least part of the above combined effects, deflection of stream 38 from direction 14 to direction 39 is converted into a division of stream 38 into two substreams 41 and 42, the first of which, adhering to wall 16 and directed towards branch 25 of conveyor 4, consists mainly of light tobacco particles, while the second, adhering to wall 17 and directed towards branch 26 of conveyor 5, consists mainly of heavy particles.

On encountering respective projections 30 and 31, each of streams 41 and 42 is further divided into two halves, each consisting of a number of bands alternating with bands in the other half. In particular, the bands in a first half of each stream 41, 42, traveling in contact with respective surfaces 28, 29, flow undisturbed up respective channels 34, 35 to respective branches 25, 26 of respective conveyors 4, 5; whereas the bands in a second half of stream 41 are deflected by surfaces 32 of projections 30 towards wall 17, so as to combine with the first half of stream 42 and so form a secondary stream 43, which is deposited by suction on to branch 26 of conveyor 5 to form a continuous layer 44 of shredded tobacco. Similarly, the bands in a second half of stream 42 are deflected by surfaces 33 of projections 31 towards wall 16, so as to combine with the first half of stream 41 and so form a secondary stream 45, which is deposited by suction on to branch 25 of conveyor 4 to form a continuous layer 46 of shredded tobacco.

Clearly, therefore, by dividing the original stream 38 into two substreams 41 and 42, and partly re-mixing the two substreams 41, 42 in controlled manner, the present invention provides, in a relatively straightforward, low-cost manner, for obtaining two secondary streams 43 and 45, and hence two layers 44 and 46, not only of substantially the same flow rate (in terms of tobacco quantity by weight per unit time), but also of substantially the same concentration of light and heavy particles and, hence, of substantially the same volume. Moreover, the offset "comb" arrangement of projections 30 and 31 provides for substantially homogeneous distribution of the light and heavy particles in layers 44 and 46, as well as for preventing interference between the deflected portions of substreams 41 and 42 across the central portion of duct 15.

We claim:

1. A method of simultaneously producing two continuous cigarette rods from respective tobacco layers (46, 44) supplied by respective conveyors (4, 5); characterized by the fact that it comprises stages consisting in forming, from a main stream (38) of shredded tobacco, two substreams (42, 41) of shredded tobacco, one consisting predominantly of relatively heavy tobacco particles, and the other predominantly of relatively light tobacco particles; directing the two substreams (41, 42) respectively towards a first (4) and second (5) of said conveyors (4, 5); and mixing part of each substream (42, 41) with the other substream, so as to feed on to the two conveyors (4, 5) two final secondary streams (45, 43) containing substantially the same concentration of light and heavy tobacco particles.

2. A method as claimed in claim 1, characterized by the fact that the part of each substream (41, 42) which is mixed with the other substream (42, 41) is equal to half of the substream (41, 42).

3. A method as claimed in claim 1, characterized by the fact that the two substreams (42, 41) are formed by pneumatically deflecting said main stream (38) into a duct (15) extending in a first direction (39) substantially perpendicular to a second traveling direction (14) of said main stream (38).

4. A method as claimed in claim 3, characterized by the fact that said main stream (38) is deflected by subjecting it to a stream of compressed air directed substantially in said first direction (39).

5. A method as claimed in claim 4, characterized by the fact that said air stream is expanded inside said duct (15).

6. A method as claimed in claim 5, characterized by the fact that said expansion is achieved by employing, for said duct (15), a duct (15) defined laterally, in a transverse direction substantially parallel to said second direction (14), by two walls (16, 17) diverging along said duct (15) in said first direction (39).

7. A method as claimed in claim 1, characterized by the fact that each said substream (41, 42) is divided longitudinally into a number of pairs of adjacent bands; a first of the bands in each pair of bands being allowed to proceed undisturbed in the original traveling direction of the respective substream (41, 42); and a second of the bands in each pair of bands being deflected towards the other substream (42, 41).

8. A method as claimed in claim 7, characterized by the fact that both bands in each said pair of bands present substantially the same flow rate.

9. A method as claimed in claim 7, characterized by the fact that a first band in each said pair of bands of each said substream (41, 42) faces a second band in a corresponding pair of bands of the other substream (52, 41).

10. A method of producing two continuous cigarette rods from respective layers (46, 44) of tobacco supplied by respective conveyors (4, 5); characterized by the fact that it comprises stages consisting in feeding a main stream (38) of tobacco in a first given direction (14); pneumatically deflecting the main stream (38) into the input end of a duct (15) extending in a second direction (39) substantially perpendicular to said first direction (14), so as to form two substreams (42, 41) of shredded tobacco, one consisting predominantly of relatively heavy particles and the other predominantly of relatively light particles, and flowing respectively along a first (17) and second (16) wall of said duct (15) facing each other and substantially perpendicular to said first direction (14), the output end of said duct (15) being closed off by said conveyors (5, 4) located respectively adjacent to said first (17) and second (16) walls; dividing each substream (41, 42) longitudinally into two substantially equal parts; and deflecting a first of said two parts of each said substream (41, 42) away from the respective said wall (16, 17) and towards the other said wall (17, 16), so as to mix it with a second of said two parts of the other substream (41, 42) and so form, along said walls (16, 17), two final secondary streams (45, 43) having substantially the same concentration of light and heavy particles, and which are intercepted by respective said conveyors (4, 5) for forming, on the conveyors (4, 5), respective said layers (46, 44) of tobacco.

11. A method as claimed in claim 10, characterized by the fact that each of said two parts of each substream (41, 42) is defined by a number of longitudinal bands alternating with bands in the other part of the substream (41, 42).

12. A method as claimed in claim 10, characterized by the fact that each substream (41, 42) is divided into said two parts by causing part of the substream (41, 42) to interfere with a respective number of projections (30, 31) extending from the respective said wall (16, 17) towards the other wall (17, 16) and equally spaced in a row perpendicular to the traveling direction of the respective substream (41, 42); the part of the substream (41, 42) interfering with the projections (30, 31) being deflected towards the other wall (17, 16).

13. A method as claimed in claim 12, characterized by the fact that said deflected parts of the two substreams (42, 41) are directed transversely in relation to said duct (15) along non-interfering paths by offsetting the projections (30, 31) in each said row in relation to the projections (31, 30) in the other said row.

* * * * *